US008486207B2

(12) United States Patent
Webb et al.

(10) Patent No.: US 8,486,207 B2
(45) **Date of Patent: *Jul. 16, 2013**

(54) LOW-SMOKE PYROTECHNIC COMPOSITION FOR PRODUCING COLORED FLAMES

(75) Inventors: Rutger Webb, Rotterdam (NL); Martijn Zebregs, Rijswijk (NL); John Franciscus Zevenbergen, Weesp (NL); Murk Pieter Van Rooijen, Stellendam (NL)

(73) Assignee: Clearspark, LLC, Glendale, CA (US)

( * ) Notice: Subject to any disclaimer, the term of this patent is extended or adjusted under 35 U.S.C. 154(b) by 388 days.

This patent is subject to a terminal disclaimer.

(21) Appl. No.: 12/577,079

(22) Filed: Oct. 9, 2009

(65) Prior Publication Data

US 2010/0024932 A1 Feb. 4, 2010

(30) Foreign Application Priority Data

Apr. 16, 2007 (EP) ..... 07106229
Apr. 16, 2008 (WO) ..... PCT/NL2008/050215

(51) Int. Cl.

| | |
|---|---|
| ***C06B 31/00*** | (2006.01) |
| ***C06B 31/02*** | (2006.01) |
| ***C06B 31/12*** | (2006.01) |
| ***C06B 31/22*** | (2006.01) |
| ***D03D 23/00*** | (2006.01) |
| ***D03D 43/00*** | (2006.01) |

(52) U.S. Cl.
USPC ..... 149/63; 149/45; 149/61; 149/62; 149/109.2; 149/109.4

(58) Field of Classification Search
USPC ..... 149/63, 45, 61, 62, 109.2, 109.4
See application file for complete search history.

(56) References Cited

U.S. PATENT DOCUMENTS

| | | | | |
|---|---|---|---|---|
| 4,078,954 | A * | 3/1978 | Bernardy | 149/19.8 |
| 5,917,146 | A * | 6/1999 | Hiskey et al. | 149/36 |
| 6,047,644 | A * | 4/2000 | Malecki et al. | 102/367 |
| 6,214,139 | B1 * | 4/2001 | Hiskey et al. | 149/36 |
| 6,599,379 | B2 * | 7/2003 | Hiskey et al. | 149/19.8 |
| 2008/0271365 | A1 * | 11/2008 | Goldfarb et al. | 44/642 |
| 2010/0024932 | A1 * | 2/2010 | Webb et al. | 149/63 |

FOREIGN PATENT DOCUMENTS

| | | | |
|---|---|---|---|
| CN | 1097186 | A | 1/1995 |
| CN | 1673203 | A | 9/2005 |
| DE | 4022991 | C1 | 4/1992 |
| EP | 1127860 | A1 | 8/2001 |
| WO | 03084900 | A1 | 10/2003 |

OTHER PUBLICATIONS

Database WPI Week, Derwent Publications Ltd., London, GB, XP002368163, Aug. 10, 1996.
Dasgupta, Purnendu K., Perchlorate in the United States. Analysis of Relative Source Contributions to the Food Chain, Environ. Sci. Technol., Nov. 21, 2006, 40, 6608-6614; XP002461863.
Goleman, Wanda L., et al., "Contribution of Ammonium Ions to the Lethality and Antimetamorphic Effects of Ammonium Perchlorate" Environmental Toxicology and Chemistry, vol. 25, No. 4, pp. 1060-1067, Apr. 2006.
Office Action, Application No. 08 741 636.8; Applicant Clearspark, LLC, dated Jan. 27, 2011.
Notification of the Second Office Action; Applicant Clearspark, LLC, mailed Jan. 12, 2012 for application No. 200880012170.4; entitled "A Low-Smoke Pyrotechnic Composition for Producing Colored Flames".
Japanese Office Action and Translation dated Apr. 3, 2012 from related Japanese Application No. 2010-504000.
Japanese Unexamined Patent Application, Publication No. S52-008793.
Japanese Unexamined Patent Application, Publication No. 2000-191391.

* cited by examiner

*Primary Examiner* — James McDonough
(74) *Attorney, Agent, or Firm* — Marsh Fischmann & Breyfogle, LLP; Kent A. Lembke

(57) ABSTRACT

The present invention provides a chlorine-containing pyrotechnic composition which is substantially free of per-chlorate which composition comprises a nitrocellulose which is derived from a fibrous nitrocellulose starting material that has at least partially been dissolved during the process of preparing the pyrotechnic composition, and a colorant. The invention further provides a firework article comprising said pyrotechnic composition, and a method for preparing the same.

32 Claims, No Drawings

LOW-SMOKE PYROTECHNIC COMPOSITION FOR PRODUCING COLORED FLAMES

RELATION TO OTHER APPLICATIONS

This application claims priority under 35 U.S.C. 371 to international application No. PCT/NL2008/050215 filed on Apr. 16, 2008 which claims priority to EP 07106229.3 filed on Apr. 16, 2007.

BACKGROUND OF TUE INVENTION

1. Field of the Invention

The present invention relates to a chlorine-containing pyrotechnic composition.

2. Relevant Background

Conventional colorful fireworks contain significant amounts of metal salts and perchlorate to generate the desired color(s). Such fireworks affect the environment since a small percentage of unburned stars or flares contain perchlorate and eventually may end up in drinking water. Another problem associated with known fireworks is the generation of a lot of smoke which causes major problems in enclosed venues as for instance sport stadiums inside cities.

In U.S. Pat. Nos. 6,214,139 and 5,917,146 metal salts of several high-nitrogen, low carbon content energetic materials are presented as viable ingredients for low-smoke fireworks compositions. The high nitrogen, low carbon content energetic materials mentioned in these documents are, however, not readily available compounds. In order to prepare these compounds multi-step syntheses are required. Furthermore, in some of these syntheses environmental unfriendly, toxic or hazardous chemical precursors are required. These two issues increase the price of the metal salts of a high-nitrogen, low-carbon content considerably.

SUMMARY OF THE INVENTION

An object of the present invention is to reduce the environmental impact of fireworks by providing a low-smoke, perchlorate-free pyrotechnic compositions that can be used in fireworks, and which compositions include a high-nitrogen content, low-carbon content material that is widely available in the chemical industry (a so-called bulk product).

Surprisingly, it has now been found that this object can be realized when use is made of a chlorine-containing pyrotechnic composition comprising a pyrotechnic fuel, a colorant and a particular nitrocellulose.

The present invention addresses the above problems by providing methods and systems for providing a low-smoke pyrotechnic compostion for producing colored flames that is substantially free of perchlorate.

DETAILED DESCRIPTION OF THE PREFERRED EMBODIMENTS

Accordingly, the present invention relates to a chlorine-containing pyrotechnic composition which comprises a nitrocellulose which is derived from a fibrous nitrocellulose starting material that has at least been partially dissolved during the process of preparing the pyrotechnic composition, a pyrotechnic fuel, and a colorant.

Apart from the fact that the chlorine-containing pyrotechnic composition according to the present invention is substantially free of perchlorate and generates little smoke, it has the advantages that it has a high extrudability, a well-controlled burning rate, and generates attractive color patterns.

The chlorine-containing pyrotechnic compositions according to the present invention are substantially free of perchlorate. In the context of the present invention this means that they will contain no more than typical LO impurity level (i.e. trace amounts) of perchlorate. So, preferably, the present pyrotechnic compositions contains less than 0.05% (m/m) (massapercentage), based on total pyrotechnic composition.

Preferably, in the pyrotechnic composition according to the present invention the nitrocellulose is present in an amount in the range of from 20-96 wt %, based on total pyrotechnic composition. More preferably, the nitrocellulose is present in an amount of 85-95 wt %, based on total pyrotechnic composition.

Preferably, the nitrocellulose to be used in accordance with the present invention has a nitrogen content of less than 14 wt %. More preferably, the nitrocellulose has a nitrogen content in the range of from 12 to 13.5 wt %.

Suitably, at least 3 wt % of the fibrous nitrocellulose starting material has been dissolved during the process of preparing the pyrotechnic composition.

Preferably, 3-80 wt % of the fibrous nitrocellulose starting material has been dissolved during the process of preparing the pyrotechnic composition.

Suitably, the fibrous nitrocellulose starting material is at least partly dissolved using a mixture of organic solvents. Suitable solvents include acetone, ethanol, ethyl acetate, butyl acetate, isopropanol butanol, methyl ethyl ketone, and methyl isobutyl ketone. Preferred solvents include acetone 10 and ethanol. Preferably, a mixture is used of acetone and ethanol.

Preferably, wherein the colorant is present in an amount in the range of from 1-10 wt %, based on total pyrotechnic composition.

Preferably, the colorant is selected from the group consisting of strontium aminotetrazole, barium aminotetrazole, strontium nitrate, barium nitrate, and barium chlorate.

Preferably, the colorant comprises strontium aminotetrazole or barium aminotetrazole.

Suitably, the present pyrotechnic composition comprises in addition an oxidator in an amount in the range of from 1-80 wt %, based on total LO pyrotechnic composition.

Preferably, the oxidator is chosen from the group consisting of $NH_4ClO_4$, $KClO_4$, $KClO_3$, $KNO_3$, $NH_4NO_3$, $Sr(NO_3)_2$, $Ba(NO_3)_2$, and $Ba(ClO_3)_2$.

More preferably, the oxidator comprises NH4NO3, $Sr(NO_3)_2$ or $Ba(NO_3)_2$.

The present invention also relates to a firework article comprising the pyrotechnic composition according to the present invention.

In addition, the present invention also provides a method for preparing the pyrotechnic composition according to the invention, which method comprises mixing the nitrocellulose starting material, the colorant and the 0.0 chlorine donor and mixing the mixture so obtained with a mixture of organic solvents, extruding the material thus obtained, and evaporating the solvent present in the extruded material so as to obtain a porous material.

The metal salt can be obtained by reacting a corresponding metal compound with 5-aminotetrazole. Preferably, the metal salt is obtained by reacting the corresponding metal hydroxide, metal sulphate, metal chloride or metal nitrate with 5-aminotetrazole. More preferably, the metal salt is obtained by reacting the corresponding metal hydroxide or metal nitrate with 5-aminotetrazole. Most preferably, the metal salt is obtained by reacting the corresponding metal hydroxide with 5-aminotetrazole.

The 5-aminotetrazole can either be in anhydrous form or containing crystal water.

Suitably, the metal to be used in the metal salt is selected from the group consisting of calcium, strontium, barium, copper, potassium, iron, magnesium, lithium, boron, titanium, antimony and aluminium.

Preferably, the metal is strontium, barium or copper.

Mixtures of various metal salts can suitably be used to yield desired colors.

Suitably, the metal salt to be used can be protonated by means of an LO acid.

Suitably, the acid is selected from the group consisting of hydrogen chloride, hydrogen bromide, hydrogen iodide, hydrogen fluoride, nitric acid, chloric acid and perchloric acid.

Preferably, the acid is hydrogen chloride, chloric acid or perchloric acid.

Suitably, the oxidator is selected from the group consisting of ammonium nitrate, barium nitrate, barium chlorate, strontium nitrate, and potassium nitrate.

Preferably, the oxidator comprises ammonium nitrate.

The pyrotechnic fuel is selected from the group consisting of 0.0 nitrocellulose, cellulose, 5-amino-1H-tetrazole (CH3N5), guanidinium nitrate, Arabic gum, red gum and shellac.

Preferably, the pyrotechnic fuel comprises nitrocellulose or cellulose.

The pyrotechnic fuel to be used in accordance with the invention may be applied in liquid form as well as in powder form. Apart from nitrocellulose and cellulose also a different compound can be used as pyrotechnic fuel such as for instance 5 amino IH tetrazole.

The pyrotechnic composition according to the present invention contains chlorine. Suitably, the present pyrotechnic compositions comprise chlorine in an amount in the range of from 1-20 wt %, preferably in the range of from 0.2-5 wt %, based on total pyrotechnic composition. The chlorine can be provided by the colorant or by a separate chlorine donor. Such a chlorine donor is suitably present in an amount of from 1 to 20 wt %, based on total pyrotechnic composition.

The chlorine is preferably provided by ammonium chloride. Other chlorine donors may be used, such as those that have been described in prior art of pyrotechnics, for example chlorinated rubbers such as Parlon, Pergut, Alloprene, (tradenames), polyvinyl chloride (PVC), polyvinylidine chloride, hexachlorethane or hexachlorobenzene (C6Cl6), or chlorinated waxes or LO chlorinated parafin.

More preferably, the chlorine is provided by ammonium chloride.

The pyrotechnic composition to be used in accordance with the present invention may include other conventional components (burn rate modifier, stabilizer, processing additives, flegmatizer, etc.) which are common for those skilled in the art. If present, these components will be present in an amount of less than 10 wt %, based on total pyrotechnic composition.

The present invention also relates to a firework article comprising the pyrotechnic composition in accordance with the present invention.

In addition, the present invention relates to the use of a metal salt of 5-0 aminotetrazole as described hereinabove in a firework article.

EXAMPLES

Example 1

A pyrotechnic composition in accordance of the present invention and in the form of Red Ultra Low smoke perchlorate-free stars (codename MZ5A) was prepared having the following composition: 100 gram (94.79 wt %) nitrocellulose (NC) fibers, 13.5 wt % N from Bergerac; 5.27 gram (5 wt %) 0 strontium aminotetrazole (Sr-AT) as synthesized by the inventors; 0.22 gram (0.21 wt %) NH4Cl, pro analyse, Merck KGaG, catalogue number 1.01145.1000.

The NC was dried for two days at 45° Celsius in a Heraeus stove to remove all water. Both the Sr-AT and the NH4Cl crystals were ground to a fine powder using a mortar and pestle to ensure an intimate mixture. An Erlenmeyer flask was filled with 35.14 g acetone and 50 g ethanol. This mixture was stirred until homogenously mixed. This mixture of solvent was used to yield a ratio of NC:acetone of 74:26.

To start, half of the solvent mixture was added to 50 g of the NC, in a small scale S-blader mixer (IKA mixer). After 10 minutes the mixing blades were scraped free from lumps, after which the mixer was restarted. After 15 minutes another 25 g of NC was added after which the mixer was restarted.

After 20 minutes the finely powdered NH4Cl and Sr-AT were added to the mixer. After 35 minutes the remaining NC and solvent were added. After continued mixing at 60 minutes after start the mixer was emptied. This mixture was inserted in the Rosand Double Barrel Capillary Rheometer.

Under the barrels of this Rosand Rheometer, an extrusion nozzle of 10 mm was installed. After filling the pistons are lowered at a speed of 100 mm/min, while pressures remain between 2.5 en 3.2 MPa (25-32 bar). Underneath the Rosand Rheometer the extrudate was collected and cut manually to cylinders 1 cm long. These cylindrical stars were dried in a Heraeus stove at 40° C. for 12 hours, in order to remove all solvents, and the stars were then dried in a Gallenkamp vacuum stove at 40° C. for 5 hours.

Example 2

A pyrotechnic composition in accordance of the present invention and in the form of Green Ultra Low smoke perchlorate-free stars (codename MZ6) was prepared having the following composition: 100 gram (93.35 wt %) nitrocellulose fibers, 13.5 wt % N from Bergerac; 5.26 gram (4.91 wt %) barium aminotetrazole, as synthesized by the inventors; 1.86 gram (1.74 wt %) NH4Cl, pro analyse, Merck KGaG. Said composition was prepared in the same way as the Red ultra-low smoke perchlorate-free star mixture described in Example 1.

It will be clear to those skilled in the art that the Rosand Rheometer was used to produce stars on a laboratory scale (i.e. typically small scale batches), while at the same time it allows the users to measure important rheometric parameters which are crucial for large scale extrusion processes.

The Theyson Twin Screw Extruder (co-rotating, self wiping, 45 mm, 1305 screw length, 29 L/D) is a suitable and attractive option for large scale production of the pyrotechnic stars described in this specification.

We claim:

1. A pyrotechnic composition comprising:

chlorine;

an at least partially gelantinized nitrocellulose which is derived from a fibrous nitrocellulose starting material that has at least partially been dissolved during the process of preparing the pyrotechnic composition; and a colorant, wherein the pyrotechnic composition is substantially free of perchlorate, wherein the colorant is chosen from the group consisting of strontium aminotetrazole, barium aminotetrazole, strontium nitrate, barium nitrate, and barium chlorate, and wherein the colorant comprises strontium aminotetrazole or barium aminotetrazole.

2. A composition according to claim 1, wherein the nitrocellulose is present in an amount in the range of from 20-96 wt %, based on total pyrotechnic composition.

3. A composition according to claim 1 wherein the nitrocellulose has a nitrogen content of less than 14 wt %.

4. A composition according to claim 2, wherein the nitrocellulose has a nitrogen content in the range of from 12 to 13.5 wt %.

5. A composition according to claim 2, wherein the nitrocellulose is present in an amount of 85-95 wt %, based on total pyrotechnic composition.

6. A composition according to claim 1, wherein at least 3 wt % of the fibrous nitrocellulose starting material has been dissolved during the process of preparing the pyrotechnic composition.

7. A composition according to claim 6, wherein 3-80 wt % of the fibrous nitrocellulose starting material has been dissolved during the process of preparing the pyrotechnic composition.

8. A composition according to claim 1, wherein the fibrous nitrocellulose starting material is at least partly dissolved using a mixture of organic solvents.

9. A composition according to claim 1, wherein the colorant is present in an amount in the range of from 1-10 wt %, based on total pyrotechnic composition.

10. A composition according to claim 1, wherein chlorine is present in an amount of from 1 to 20 wt %, based on total pyrotechnic composition.

11. A composition according to claim 1, wherein the chlorine is provided by ammonium chloride, Pergut, Alloprene, PVC, Superchlon, hexachlorethane or hexachlorobenzene.

12. A chlorine-containing pyrotechnic composition which is substantially free of perchlorate which composition comprises a nitrocellulose which is derived from a fibrous nitrocellulose starting material that has at least partially been dissolved during the process of preparing the pyrotechnic composition, and a colorant, wherein the chlorine is provided by a donor comprising ammonium chloride.

13. A composition according to claim 1 which in addition comprises an oxidator in an amount in the range of from 1-80 wt %, based on total pyrotechnic composition.

14. A composition according to claim 13, wherein the oxidator is chosen from the group consisting of $KNO_3$, $NH_4NO_3$, $Sr(NO_3)_2$, and $Ba(NO_3)_2$.

15. A composition according to claim 14, wherein the oxidator comprises $NH_3NO_3$, $Sr(NO_3)_2$ or $Ba(NO_3)_2$.

16. A pyrotechnic composition comprising:

chlorine;

an at least partially gelantinized nitrocellulose which is derived from a fibrous nitrocellulose starting material that has at least partially been dissolved during the process of preparing the pyrotechnic composition; and a colorant, wherein the pyrotechnic composition is substantially free of perchlorate and wherein the composition further comprises a metal salt of (5-aminotetrazole) in an amount in the range of from 1-10 wt %, based on total pyrotechnic composition.

17. A composition according to claim 16, wherein the metal comprises barium, strontium or copper.

18. The composition according to claim 12, wherein the nitrocellulose is present in an amount in the range of from 20-96 wt %, based on total pyrotechnic composition.

19. The composition according to claim 12, wherein the nitrocellulose has a nitrogen content of less than 14 wt %.

20. The composition according to claim 12, wherein 3-80 wt % of the fibrous nitrocellulose starting material has been dissolved during the process of preparing the pyrotechnic composition.

21. The composition according to claim 12, wherein the fibrous nitrocellulose starting material is at least partly dissolved using a mixture of organic solvents.

22. A composition according to claim 16, wherein the nitrocellulose is present in an amount in the range of from 20-96 wt %, based on total pyrotechnic composition.

23. A composition according to claim 22, wherein the nitrocellulose is present in an amount of 85-95 wt %, based on total pyrotechnic composition.

24. A composition according to claim 16, wherein the nitrocellulose has a nitrogen content of less than 14 wt %.

25. A composition according to claim 16, wherein the nitrocellulose has a nitrogen content in the range of from 12 to 13.5 wt %.

26. A composition according to claim 16, wherein at least 3 wt % of the fibrous nitrocellulose starting material has been dissolved during the process of preparing the pyrotechnic composition.

27. A composition according to claim 26, wherein 3-80 wt % of the fibrous nitrocellulose starting material has been dissolved during the process of preparing the pyrotechnic composition.

28. A composition according to claim 16, wherein the fibrous nitrocellulose starting material is at least partly dissolved using a mixture of organic solvents.

29. A composition according to claim 16, wherein the colorant is present in an amount in the range of from 1-10 wt %, based on total pyrotechnic composition.

30. A composition according to claim 16, further comprising an oxidator in an amount in the range of from 1-80 wt %, based on total pyrotechnic composition.

31. A composition according to claim 30, wherein the oxidator is chosen from the group consisting of $KNO_3$, $NH_4NO_3$, $Sr(NO_3)_2$, and $Ba(NO_3)_2$.

32. A composition according to claim 31, wherein the oxidator comprises $NH_3NO_3$, $Sr(NO_3)_2$, or $Ba(NO_3)_2$.

* * * * *